US006562427B2

(12) United States Patent
Hung

(10) Patent No.: US 6,562,427 B2
(45) Date of Patent: May 13, 2003

(54) AIRBAG FOR SHOES

(75) Inventor: Hun-Fa Hung, Taichung (TW)

(73) Assignee: Chinook Trading Company, Tigard, OR (US)

( * ) Notice: Subject to any disclaimer, the term of this patent is extended or adjusted under 35 U.S.C. 154(b) by 9 days.

(21) Appl. No.: 09/976,203

(22) Filed: Oct. 11, 2001

(65) Prior Publication Data

US 2003/0072909 A1 Apr. 17, 2003

(51) Int. Cl.[7] ..... B32B 1/02

(52) U.S. Cl. ..... 428/36.9; 428/76; 36/28; 36/35 R; 36/38

(58) Field of Search ..... 428/36.9, 76; 36/29, 36/35 B, 28, 37, 38, 35 R

(56) References Cited

U.S. PATENT DOCUMENTS 4,918,838 A * 4/1990 Chang ..... 36/28

* cited by examiner

*Primary Examiner*—Alexander S. Thomas
(74) *Attorney, Agent, or Firm*—Chernoff, Vilhauer, McClung & Stenzel, LLP

(57) ABSTRACT

An airbag for shoes has a plurality of elastically compressible cylindrical cushion members which are interconnected in a predetermined array by a connecting plate. The cushion members/connecting plate combination is encapsulated in a casing. The cushion members, connecting plate and casing are joined together to form an integral unit. The cushion members have a spiral groove formed in their outer surface which increases their compressibility during the initial phase of compression.

6 Claims, 2 Drawing Sheets

AIRBAG FOR SHOES

BACKGROUND AND SUMMARY OF THE INVENTION

This invention relates to an airbag for shoes and particularly to an airbag which contains mechanical cushion members to provide long life and to provide support if the airbag should become punctured.

Airbags are commonly placed in the soles of sneakers to cushion the bottoms of the user's feet from the impact of running or walking. However, airbags do not provide sufficient cushioning for high loads and can lose their cushioning effect after repeated use. In co-pending application Ser. No. 29149621, now U.S. Design Patent D460854 resiliently flexible, cylindrical cushion members are placed in an airbag at spaced-apart locations. The cushion members are held in their desired locations by a stiffer flexible connecting plate, and the cushion members and the connecting plate are enclosed in a flexible casing. The cushion member, connecting plate and casing, are all made from a plastic material and are cast together to form an integral unit. While this type of airbag is an improvement over the previous airbags, if the cushion members are stiff enough to give adequate cushioning at high loads, they are too stiff at light loads or during the initial stages of loading.

The airbag of the subject invention overcomes this problem by placing spiral grooves around the periphery of the cushion members to give them a spring-like structure. This allows the cushion members to be less stiff under light or initial loading and still have sufficient stiffness to provide the necessary cushioning effect at higher levels of loading.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
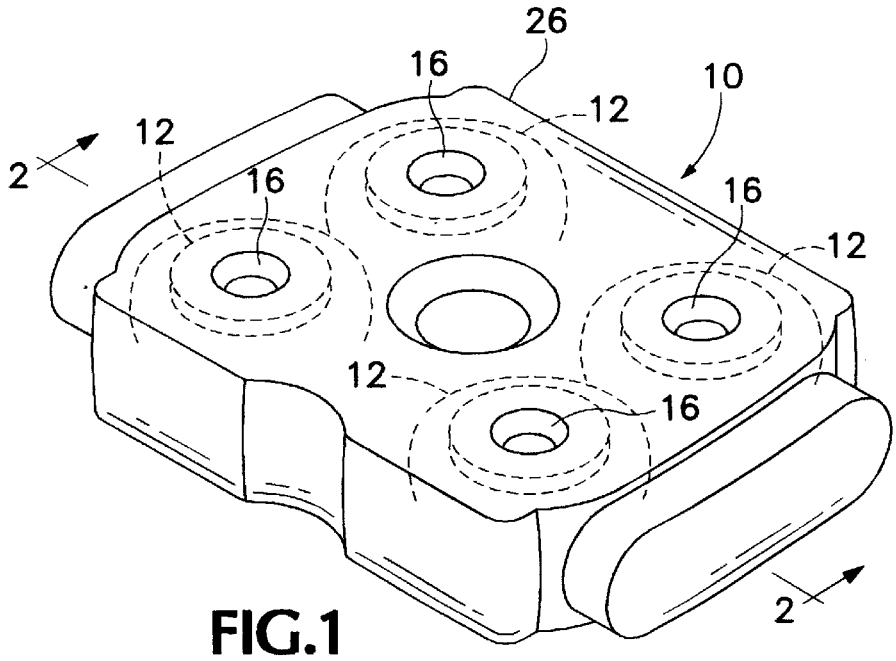
FIG. 1 is a perspective view of an airbag for shoes embodying the subject invention.
Figure 2:
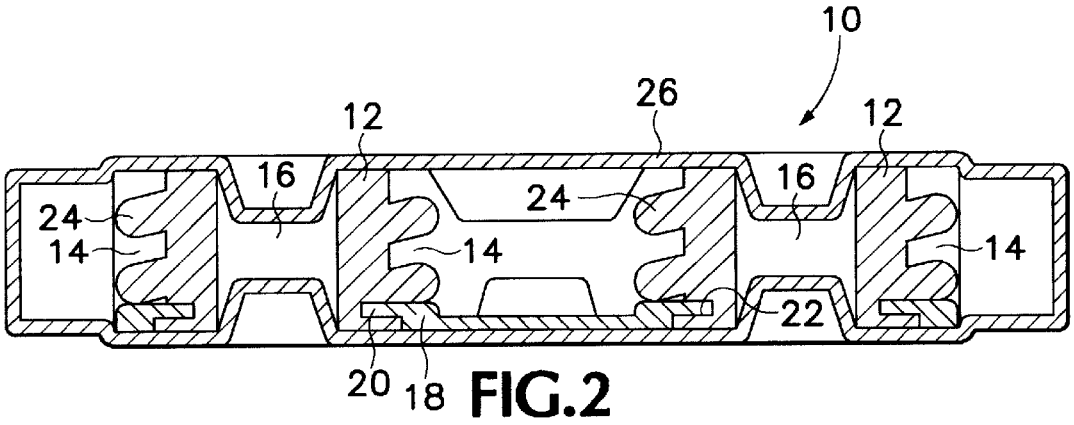
FIG. 2 is a cross-sectional view taken on line 2—2 of FIG. 2.
Figure 4:
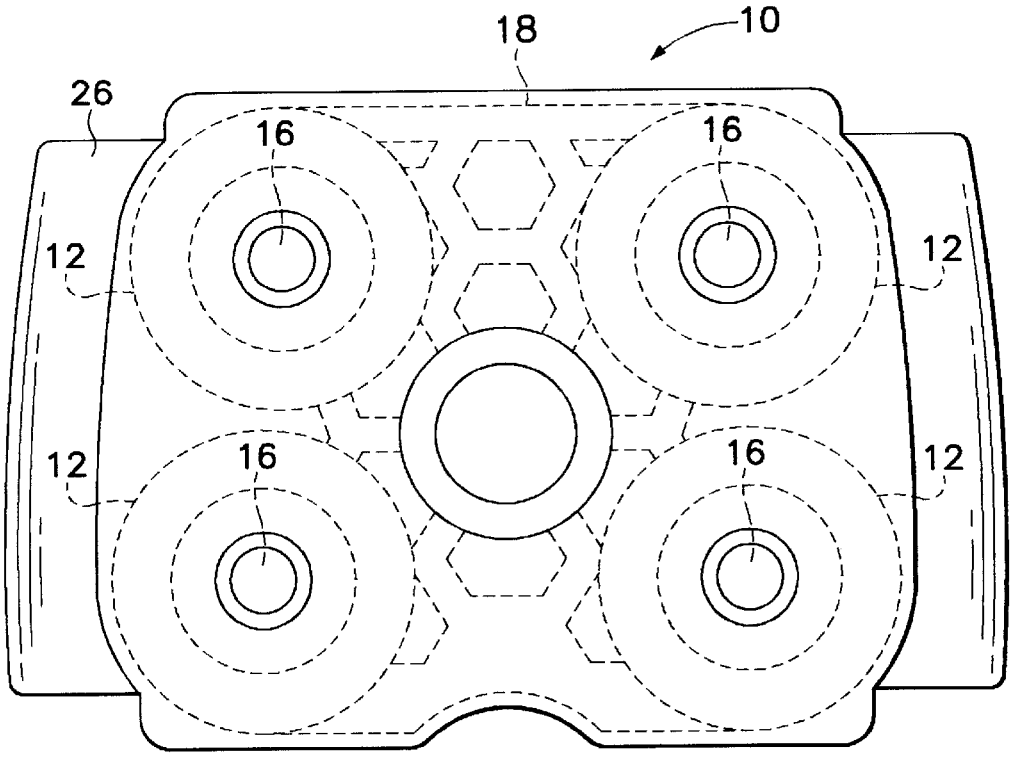
FIG. 4 is a plan view of the airbag shown in FIGS. 1 and 2.

Referring to FIGS. 1, 2 and 4 of the drawings, a first preferred embodiment of an airbag 10 includes a plurality of individual cushion members 12. The cushion members are elastically compressible and are made from a material whose resistance to compression becomes greater as it becomes more compressed. In this preferred embodiment the cushion members are made from a soft plastic material such as polyvinyl chloride or polyurethane, although any elastically compressible material would work. The cushion members are cylindrical and have a spiral groove 14 formed in their outer surface. The cushion members illustrated are circular in cross-section but other cross-sectional shapes would work as well. The cushion members illustrated are annular with an open center 16, but they also could be solid.

In the embodiment illustrated there are four cushion members 12 but there could be more or less. The cushion members are shown as being spaced apart from one another at the corners of a rectangle, but any pattern which places them evenly over the airbag would suffice. In order to maintain the cushion members in the desired relationship relative to one another they are attached to a semi-rigid connecting plate 18. While the connecting plate needs to be harder and less flexible than the cushion members, it could be made from the same or a similar material. The connecting plate has projecting annular fingers 20 which fit into notches 22 located in the bottoms of the cushion members. Because the cushion members and connecting plate are made from similar materials, one can be placed in the mold when the other is being cast, which will cause them to be integrally joined. As a result, the connecting plate securely holds the cushion members in place. The cushion member/connecting plate combination is encapsulated in a casing 26. The casing is formed from a relatively soft plastic material and is air-tight. The casing is cast around the assembled cushion member/connecting plate combination and thus is integrally bonded to it. In addition, the casing extends into both sides of the open centers 16 of the cushion members to form an even better bond between them.

In operation, the air-tight casing 26 forms an airbag which is inserted into the sole of a shoe (not shown) in the conventional manner. The cushion members 12 add to the airbag's resistance to deflection and provide an independent source of cushioning in case the airbag becomes punctured. In addition, the solid cushion members lose little of their cushioning ability after repeated use. Unlike conventional airbags having cushion members located in them, the cushion members of the subject invention provide less cushioning effect during their initial compression. This is because the projecting spiral element 24 collapses into the spiral groove 14 as the cushion member is initially compressed. However, once the spiral element has completely collapsed against itself the compressibility of the cushion member increases and becomes similar to the compressibility of a cushion member without a spiral groove.

Figure 3:
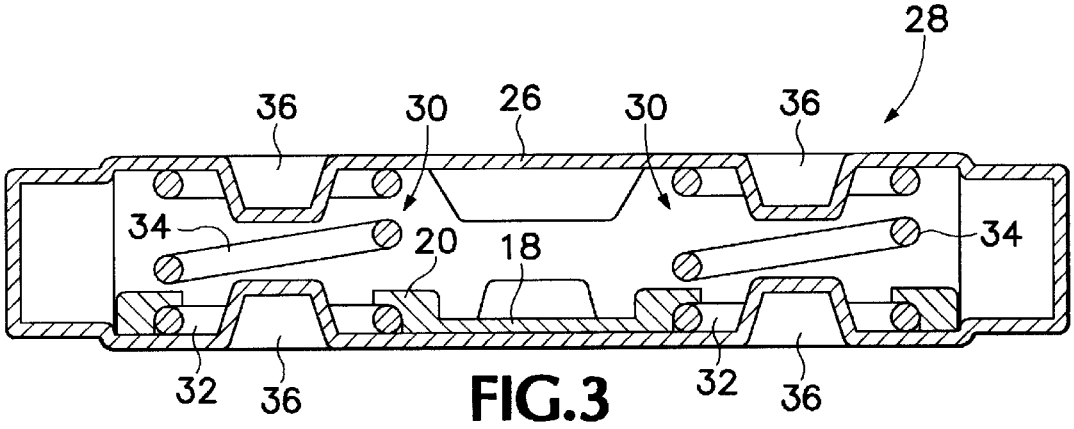
FIG. 3 is a cross-sectional view similar to FIG. 2, showing another embodiment of the invention.
Figure 5:
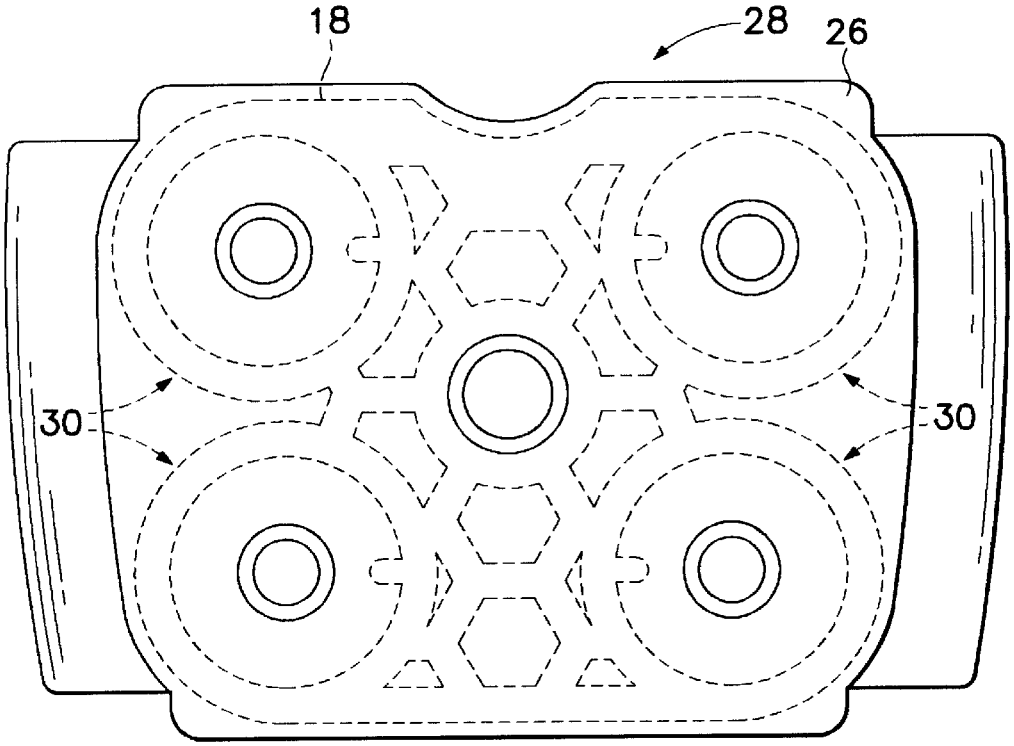
FIG. 5 is a plan view of the airbag shown in FIG. 3.

In an alternative embodiment 28 of the invention, shown in FIGS. 3 and 5, the cushion members 12 are replaced by spiral coil springs 30. The springs 30 typically would be metal but they could be made from other materials as well. In this embodiment the fingers 20 of the connection plate 18 fit over the bottom coils 32 of the springs. The top and bottom coils of a spring are perpendicular to the center line of the spring rather than spiral like the intermediate coils 34. Thus the casing 26 fits snugly against the top and bottom coils and projects into the central openings 36 of the springs. Otherwise this embodiment of the subject invention is the same as the embodiment shown in FIGS. 1, 2 and 4. However, the casing and connection plate do not bond to the spring 30 in the same manner as they do to the cushion members 12.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An airbag comprising:

(a) a plurality of elastically compressible cushion members;

(b) a connecting plate which is attached to said cushion members and holds said cushion members in a defined array;

(c) an air-tight casing which surrounds said cushion members and said connecting plate; and (d) wherein said cushion members are cylindrical and have a spiral groove defined therein to provide a spring-like structure.

2. The airbag of claim 1 wherein said cushion members and said connecting plate are integrally joined.

3. The airbag of claim 2 wherein said cushion members, said connecting plate and said casing are integrally joined.

4. The airbag of claim 3 wherein said cushion members, said connecting plate and said casing are made from a similar plastic material.

5. The airbag of claim 1 wherein said cushion members are annular with open centers.

6. The airbag of claim 5 wherein said casing extends partially into said open centers.

* * * * *